US005722030A

United States Patent [19]

Kato

[11] Patent Number: 5,722,030

[45] Date of Patent: Feb. 24, 1998

[54] RECORDING APPARATUS AND SORTER CAPABLE OF REDUCING CURL OF SHEET

[75] Inventor: Katsuhito Kato, Kawasaki, Japan

[73] Assignee: Canon Kabushiki Kaisha, Tokyo, Japan

[21] Appl. No.: 686,510

[22] Filed: Jun. 26, 1996

Related U.S. Application Data

[63] Continuation of Ser. No. 509,666, Jul. 31, 1995, abandoned.

[30] Foreign Application Priority Data

Aug. 3, 1994 [JP] Japan ..... 6-182315

[51] Int. Cl.[6] ..... G03G 21/00

[52] U.S. Cl. ..... 399/403; 399/405; 399/406; 271/288; 271/293

[58] Field of Search ..... 399/403, 406, 399/405; 271/288, 292, 293

[56] References Cited

U.S. PATENT DOCUMENTS

| | | | |
|---|---|---|---|
| 4,322,069 | 3/1982 | Mitchell | 271/296 |
| 5,012,298 | 4/1991 | Johdai et al. | 355/323 |
| 5,099,292 | 3/1992 | Hirose | 355/324 |
| 5,282,611 | 2/1994 | Ueda et al. | 270/53 |
| 5,345,303 | 9/1994 | Hiroi et al. | 399/403 |

FOREIGN PATENT DOCUMENTS

| | | |
|---|---|---|
| 63-57469 | 3/1988 | Japan . |
| 63-180676 | 7/1988 | Japan . |
| 1-127565 | 5/1989 | Japan . |

*Primary Examiner*—Nestor R. Ramirez

*Attorney, Agent, or Firm*—Fitzpatrick, Cella, Harper & Scinto

[57] ABSTRACT

A sorter for enclosing sheets ejected out from a recording apparatus of an electrophotographic type includes a plurality of movable trays for enclosing the sheets, and a driving unit for driving the tray so as to move the tray. In the present sorter, the driving unit widens a distance between the tray to which the sheet is enclosed and the tray adjacent to the tray and, after the sheet was enclosed to the tray, the driving unit reduces the distance between the tray to which the sheet was enclosed and the tray adjacent to the tray so as to press a curl of the sheet. By vertically moving the plurality of trays, the distance between the trays is changed and the tray to enclose the sheet is changed. Each time a predetermined number of sheets are enclosed to the tray, the plurality of trays are moved upward and, after the elapse of a predetermined time, the plurality of trays are moved downward.

26 Claims, 20 Drawing Sheets

| |
|---|
| FIG. 11A |
| FIG. 11B |

| FIG. 12A |
| --- |
| FIG. 12B |

RECORDING APPARATUS AND SORTER CAPABLE OF REDUCING CURL OF SHEET

This application is a continuation of application Ser. No. 08/509,666, filed Jul. 31, 1995, now abandoned.

BACKGROUND OF THE INVENTION

1. Field of the Invention

The invention relates to a recording apparatus and a sorter which can reduce a curl of a sheet.

2. Related Background Art

Hitherto, a sorter of the bin moving type movably having a plurality of bins which can enclose sheets which are ejected out after images were formed thereon or a sorter of the bin fixed type for sorting sheets after images were formed thereon into a plurality of fixed bins is connected to a copying machine or the like.

However, in the case where the conventional sorter as mentioned above is attached to a color copying machine, there are the following problems.

Namely, generally, an image such as a photograph or the like is often used as an original to be copied by the color copying machine. After the image was transferred to the sheet, the sheet passes through a fixing unit. A toner T is fixed to the whole image forming region on the surface of the sheet as shown in FIGS. 19A and 20A. When the toner T which was thermally expanded just after the fixing process is cooled with an elapse of time, the toner T is contracted on the whole image forming region of a sheet S, so that the sheet S is largely curled as shown in FIGS. 19B and 20B. As the sheet S is cooled, a curl amount increases. When such a curled sheet S is ejected out onto a bin (b) of a sorter B from a color copying machine A as shown in FIGS. 21 and 22, a rear edge of the sheet S rides over a rear edge receiving portion (right edge portion in the diagram) of the bin (b), so that there is a problem such that a sheet ejecting port of the sorter B is cheked by the sheet S and a paper jam occurs. On the other hand, in the case where a height (l) of the rear edge receiving portion of the bin (b) is increased so that the sheet S with a large curl amount can be also stacked, there are problems such that the whole apparatus increases in size and the costs rise.

SUMMARY OF THE INVENTION

It is an object of the invention to provide a recording apparatus and a sorter which can solve the above problems.

Another object of the invention is to provide a recording apparatus and a sorter which can certainly stack sheets onto a bin in consideration of a curl occurring in the sheet on which an image was formed and can also avoid an increase in size of the whole apparatus.

The above and other objects and features of the present invention will become apparent from the following detailed description and the appended claims with reference to the accompanying drawings.

DETAILED DESCRIPTION OF THE PREFERRED EMBODIMENTS

[First embodiment]

Figure 1:
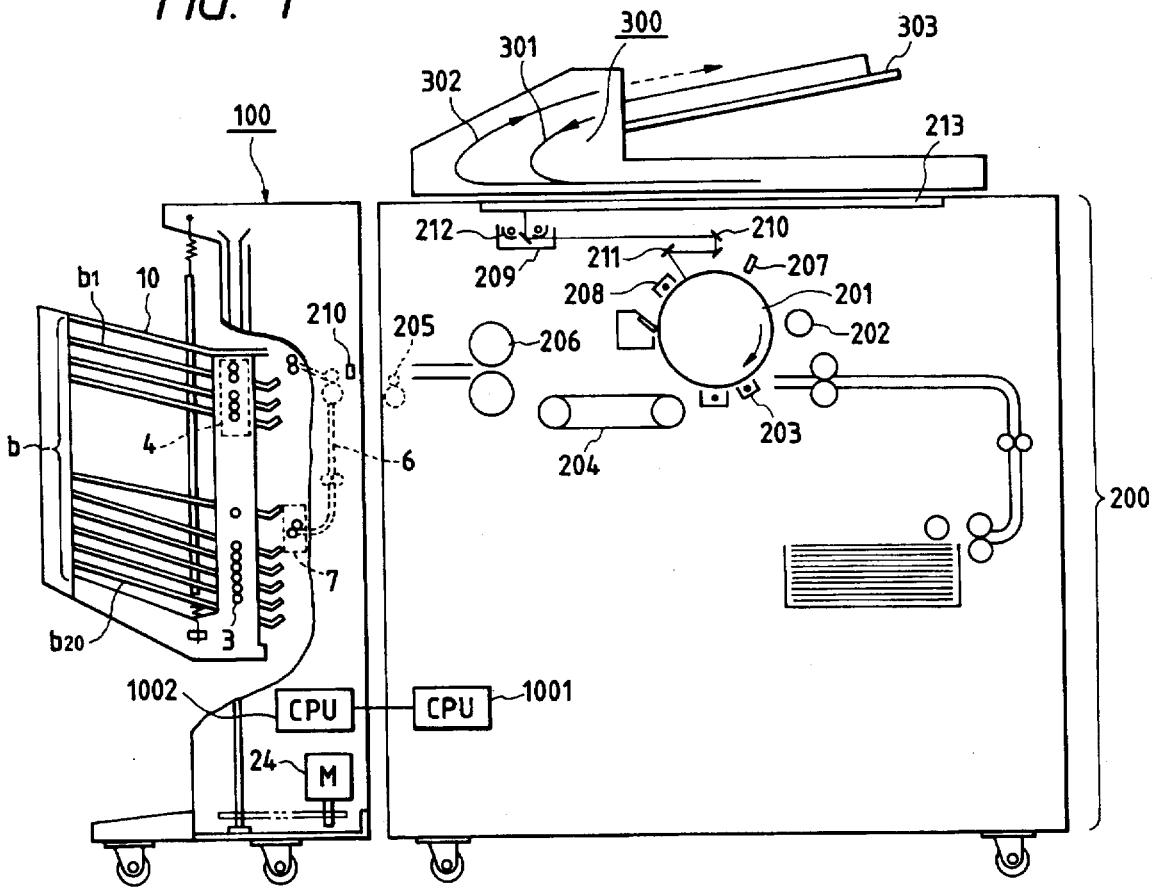
FIG. 1 is a constructional diagram showing a whole image forming apparatus of the first embodiment of the invention.

FIG. 1 is a diagram showing a whole image forming apparatus according to the first embodiment of the invention. As shown in FIG. 1, an automatic document feeder (ADF) 300 is installed on the upper surface of an image forming apparatus main body 200. The ADF 300 is a recyclic automatic document feeder such that originals put on an original tray 303 are separated one by one and are conveyed to an exposing position from a direction shown by an arrow 301, the original after it was exposed is conveyed onto the original tray 303 from a direction shown by an arrow 302, and the exposed original returned onto the original tray 303 can be again fed to the exposing position. A sorting apparatus 100 having twenty bin trays (b: b1, b2, . . . , b19, b20) is attached on the downstream side of the ADF 300.

As an image forming apparatus main body 200, a well-known electrophotographic system is used. Although its detailed description is omitted here, an image of an original positioned on a platen glass 213 is read and formed onto a photosensitive drum 201 by an optical system (209 to 212). The image is transferred onto a sheet by a developing unit 202 and a transfer electrode 203 arranged around the photosensitive drum 201 and is permanently fixed by a fixing unit 206. Reference numeral 208 denotes a primary charger for charging the photosensitive drum 201 to a predetermined potential.

As a sorting apparatus 100, what is called a bin moving type sorter is used. The bin trays (b) stacked in the vertical direction are elevated up or down one stage by one by one rotation of spiral cams 4 attached to both side portions. A driving force from a shift motor 24 is transferred to the spiral cams 4.

Figure 2:
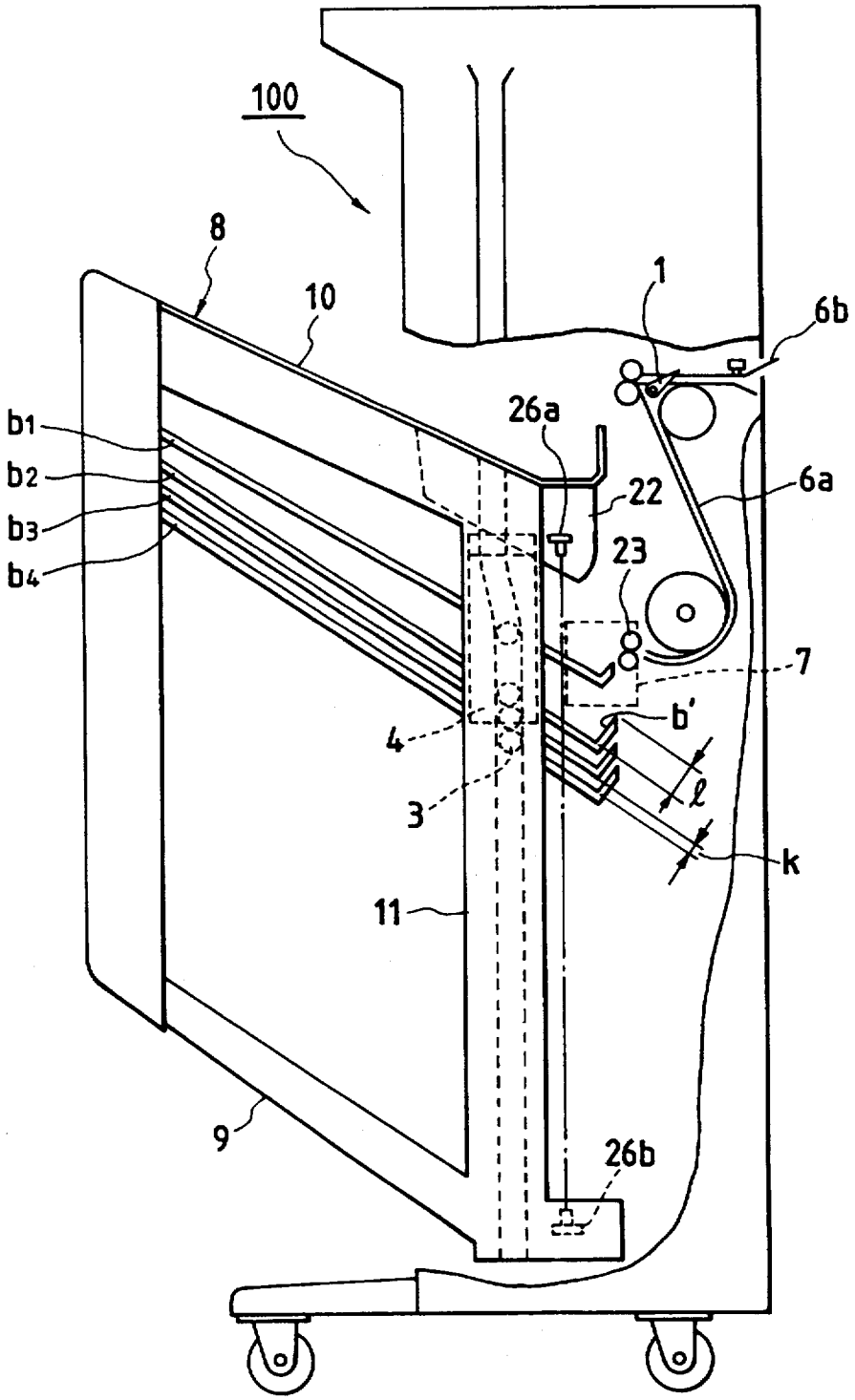
FIG. 2 is a constructional diagram with a part cut away of a sorting apparatus shown in FIG. 1.

The sheet formed with the image by the image forming apparatus main body 200 is sent to the sorting apparatus 100 through a pair of ejecting rollers 205 and is conveyed to a sort path 6*a* or a non-sort path 6*b*. Either one of the sort path 6*a* and the non-sort path 6*b* is selected by a flapper 1 in FIG. 2. In the non-sorting mode in which sheets are not sorted, the flapper 1 is set to a downward facing state, so that all of the sheets after the images were formed pass through the non-sort path 6*b* and are ejected out onto a non-sort tray 10. In the sorting mode in which sheets are sorted, on the other hand, the flapper 1 is set into an upward facing state as shown in FIG. 2. The sheets after the images were formed pass through the sort path 6*a* and are ejected out by an ejecting roller 23 and are enclosed onto each bin tray (b) which is elevated up or down synchronously with the ejection of the sheets. The non-sort tray 10 is also referred to as a "non-sort bin", each bin tray (b) is also referred to as a "sort bin", and they are also generally simply referred to as "bins".

In FIG. 2, reference numeral 7 (portion surrounded by a broken line) denotes a motor-driven stapler for stapling the sheets. The stapler 7 is attached at a predetermined position which faces the bin tray (b) and can staple a bundle of sheets stacked on the bin (b).

Figure 3:
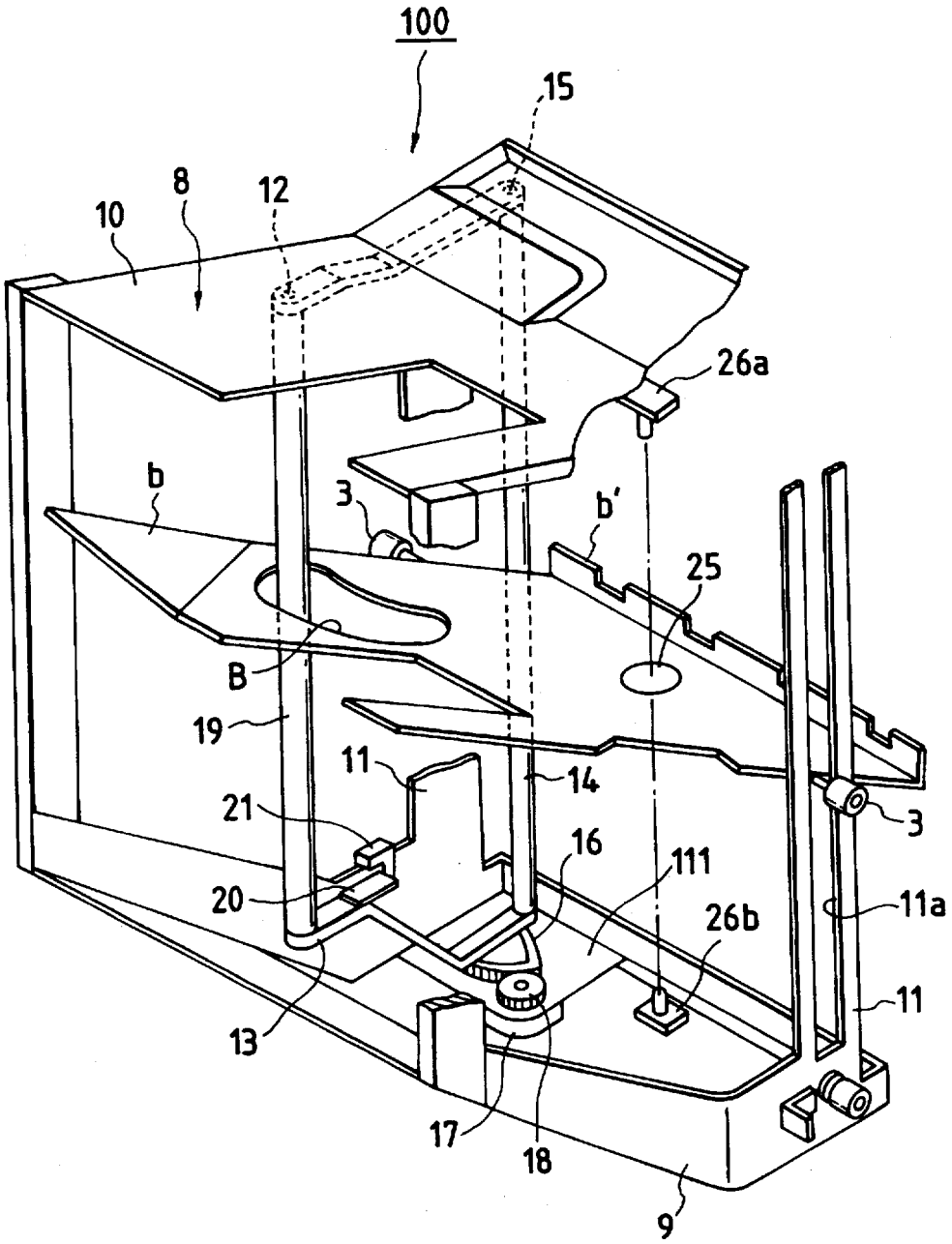
FIG. 3 is a perspective view with a part cut away of the sorting apparatus shown in FIG. 1.

As shown in FIG. 3, a bin unit 8 for holding the bin tray (b) has a box-like shape such that guide side plates 11 are attached on both side portions so as to cover a region from the non-sort tray 10 to a base frame 9. Pins (trunnions) 3 fixed to both side portions of the bin tray (sort bin) (b) are inserted into holes 11*a* of the guide side plates 11. The bin tray (b) is arranged so that the upstream side in the ejecting direction is downwardly inclined (inclined downwardly to the right in FIG. 2). A supporting plate 111 is attached to the rear side of the base edge portion of the base frame 9. A rotational center axis 14 is rotatably supported between a rotational axis (not shown) provided for the supporting plate 111 and a rotational axis 15 provided on the lower surface of the non-sort tray 10. An upper edge portion of the rotational center axis 14 is fixed to an upper arm 12 and a lower edge portion is fixed to a lower arm 13. A fan-type gear 16 is rotatably arranged to the supporting plate 111 around the rotational axis (not shown) as a rotational center which is provided for the supporting plate 111. The lower arm 13 is fixed to the fan-type gear 16.

Further, a pulse motor 17 is arranged on the lower side of the supporting plate 111. A gear 18 fixed to an output shaft of the pulse motor 17 is came into engagement with the fan-type gear 16. An aligning rod 19 which penetrates a notch B formed in each bin tray (b) is attached to an edge portion of the lower arm 13 and an edge portion of the upper arm 12. The aligning rod 19 is swung by a rotation of the fan-type gear 16. Further, a light shielding plate 20 is provided for the lower arm 13. When the light shielding plate 20 is swung integratedly with the lower arm 13, a home position sensor 21 arranged on the rear side of the base frame 9 is turned on or off.

Figure 4:
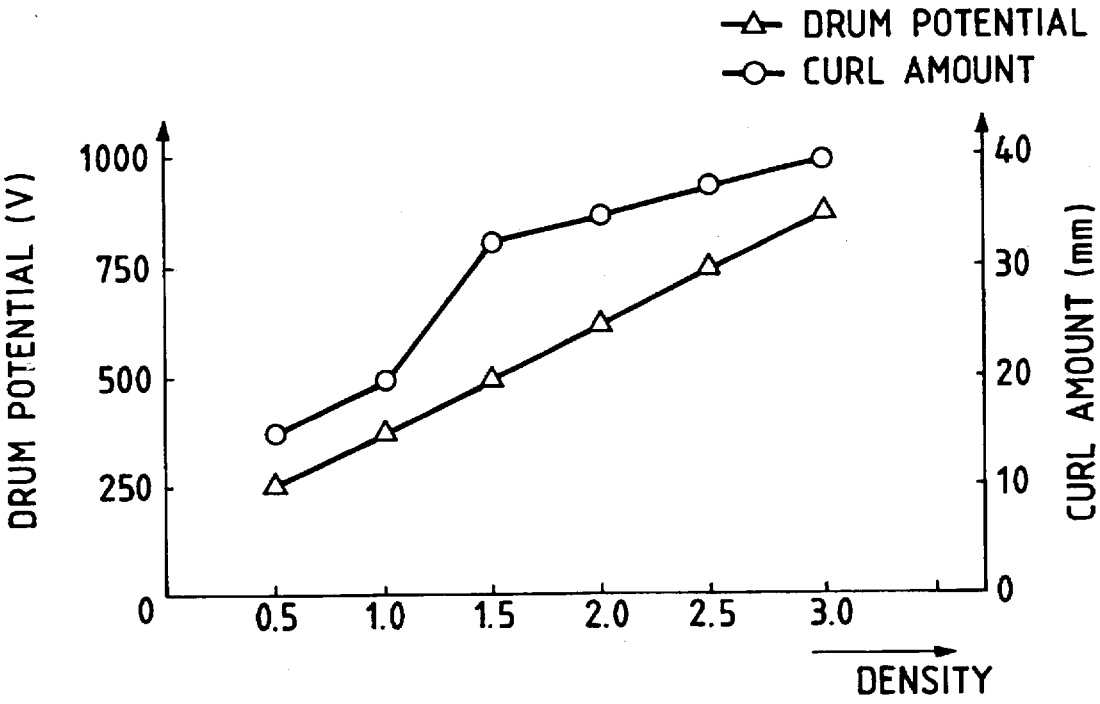
FIG. 4 is a diagram showing the correlations among the surface potential of a drum shown in FIG. 1, the image density, and the curl amount of a sheet.

As an image forming apparatus 200, a well-known electrophotographic system is used and its detailed description is omitted here. The image of the original positioned on the platen glass 213 (refer to FIG. 1) is scanned by the optical system (209 to 212). A latent image is formed on the photosensitive drum 201 which was charged to a predetermined potential by the primary charger 208. In the embodiment, the image forming apparatus is constructed so as to reduce the potential of the exposed portion on the photosensitive drum 201. As for the portion in which an image density of the original is high, an amount of light which is reflected upon scanning is small, so that the potential on the photosensitive drum 201 after completion of the exposure rises. On the contrary, as for the portion in which the image density of the original is low, since an amount of light which is reflected upon scanning is large, the potential on the photosensitive drum 201 after completion of the exposure decreases. Reference numeral 207 denotes a potential sensor which can measure the potential on the photosensitive drum 201 after completion of the exposure. According to the embodiment, therefore, a degree of the image density of the original can be judged by the potential detected by the potential sensor 207. As the image density of the original is dense, namely, as a large quantity of developing agent is transferred to the sheet, the sheet is curled largely. FIG. 4 is a diagram showing the correlations between the image density and the measured voltage of the potential sensor 207 and between the image density and the curl amount of the sheet, respectively.

Figure 5:
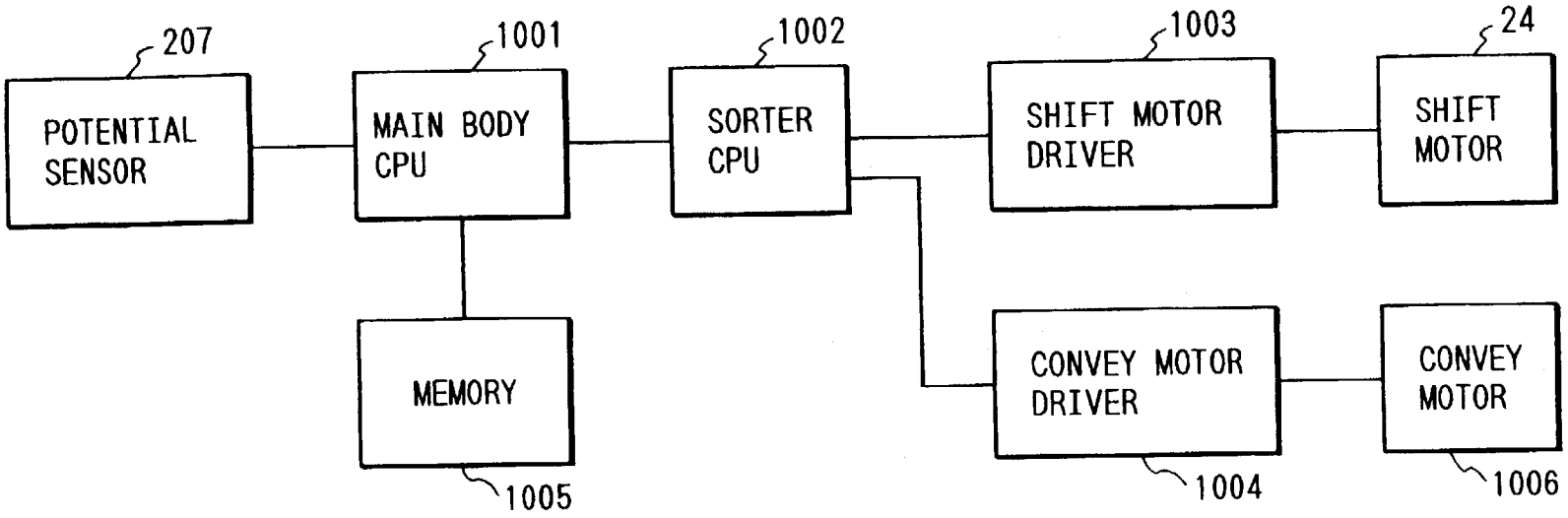
FIG. 5 is a block constructional diagram of the image forming apparatus shown in FIG. 1.

A detection signal of the potential measured by the potential sensor 207 is sent to a CPU 1001 (refer to FIG. 5) on the image forming apparatus 200 side and is, further, sent from the main body CPU 1001 to a sorter CPU 1002 on the sorting apparatus 100 side. The detection signal of the potential is compared with a predetermined threshold value in the sorter CPU 1002. When the value of the detection potential is larger than the predetermined threshold value, driving signals are transmitted from the sorter CPU 1002 to a shift motor driver 1003 and a convey motor driver 1004, so that the shift motor 24 and a convey motor 1006 of the sheet are made operative. In case of the embodiment, the height (l) (refer to FIG. 2) of a sheet rear edge receiving portion b' of the bin tray (b) is set to a value such that the sheet whose curl amount is equal to up to 20 mm can be stacked. The above threshold voltage is set to 375V in correspondence to such a curl amount (refer to FIG. 4).

The operation in each of the operating modes to be selected will now be described.

(One-copy staple sorting mode)

Figure 6:
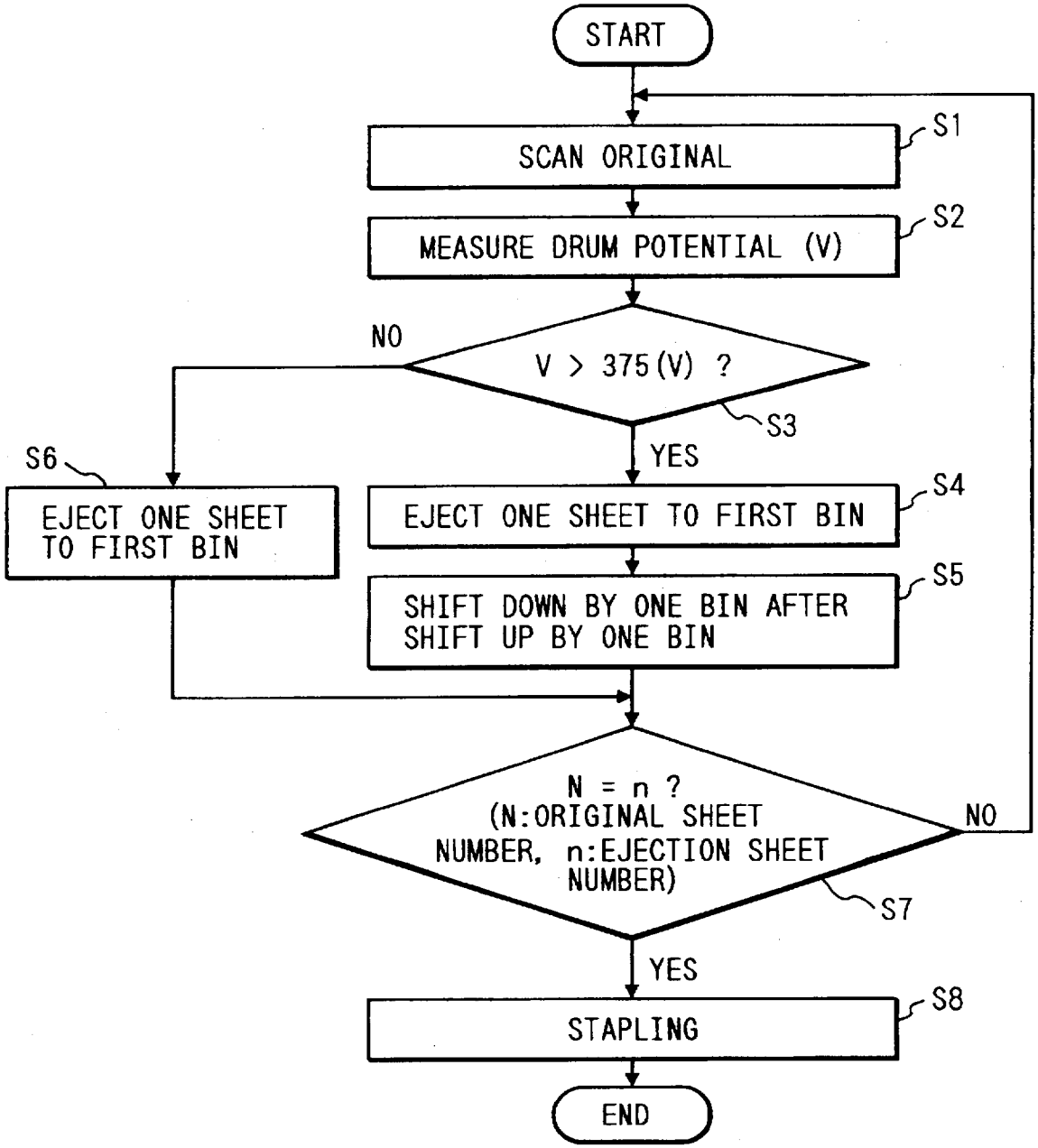
FIG. 6 is a flowchart for explaining the operation in a one-copy stapling mode of the image forming apparatus shown in FIG. 1.

A one-copy staple sorting mode will be first described with reference to a flowchart shown in FIG. 6.

When the one-copy staple sorting mode is selected by a console unit (not shown), the original is first conveyed onto the platen glass 213 by the ADF 300 and its original image is scanned by the optical system (209 to 212) (step S1). The drum potential is subsequently measured by the potential sensor 207 (step S2). A check is made to see if the drum potential (V) is larger than the threshold voltage of 375V or not (step S3).

Figure 7:
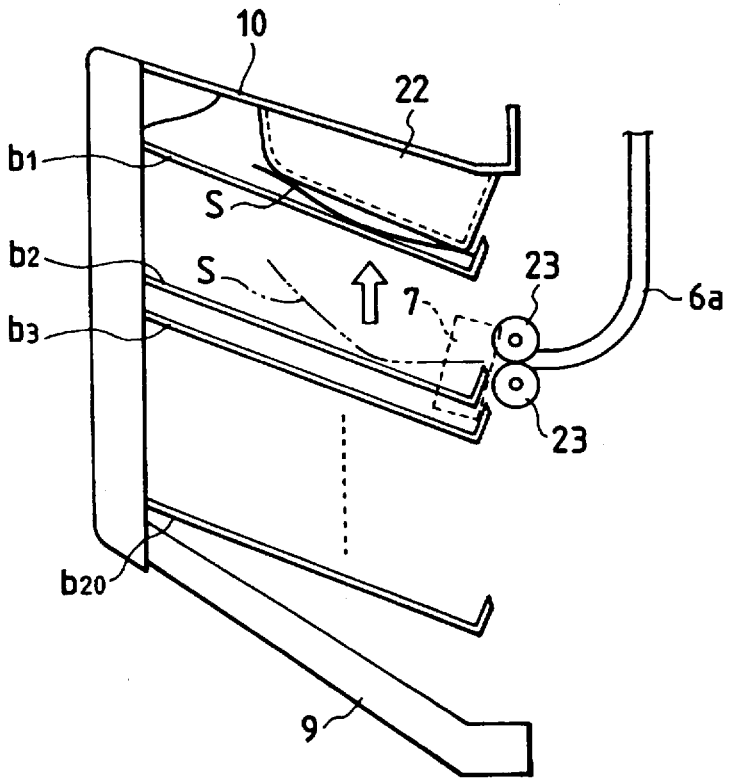
FIG. 7 is a side elevational view of a main section for explaining a state in which a curled portion of a sheet is depressed in the one-copy stapling mode of the image forming apparatus shown in FIG. 1.

When the drum potential is larger than 375V, since the curl amount of the sheet is equal to or larger than 20 mm as will be obviously understood from FIG. 4, one sheet is ejected out to the first bin tray b1 (step S4). After that, the bin group is temporarily shifted up by a distance of only one bin. Thus, an interval between a pressing member 22 provided in the lower portion of the non-sort tray 10 and the bin tray b1 is narrowed, thereby providing a state in which the sheet is ejected out to the bin tray b2. After the elapse of a predetermined time from the shift-up, the bin group is shifted down by a distance of only one bin (step S5) and is returned to the original position. When the first bin tray b1 is temporarily shifted up, the curled portion of the sheet S on the bin tray b1 is depressed by the pressing member 22 provided below the non-sort bin 10 as shown in FIG. 7, so that a degree of curl is corrected so as to be reduced. The interval between the pressing member 22 and the first bin tray b1 at that time is set to a value such that the curled sheet S can be sufficiently pressed to the bin tray b1. Since the curled sheet is the sheet just after it passed through the fixing unit 206, it has a heat. Since the sheet is pressed in a state with such a heat, the curl amount can be reduced. Since the first bin tray b1 is returned to the original position by the shift-down after completion of such a temporary shift-up, the apparatus is set to a state in which the second sheet is ejected out onto the bin tray b1.

On the other hand, when the drum potential is equal to or less than 375V, since the curl amount of the sheet is small, the sheet is simply ejected out to the first bin tray b1 (step S6). The temporary shift-up and shift-down of the first bin tray b1 are not executed.

In a manner similar to the above, until the number (n) of sheets ejected reaches the number N of originals, the operations for sequentially recording the images onto the sheets and for ejecting out the sheets onto the bin tray b1 are repeated (step S7). Each time the sheet which is curled because the recording density of the image is large is ejected out, the bin tray b1 is temporarily shifted up and down.

When the sheets of the number corresponding to the number N of originals are ejected out to the bin tray b1, the N sheets stacked on the bin tray b1 are stapled by the stapler 7 (step S8).

As mentioned above, when the curl amount of the sheet is large, the bin tray is temporarily shifted up and the curled portion is pressed and, after that, the sheets are sequentially stacked.

Since the bin tray is shifted up only in the necessary case, a loss time can be minimized.

(Sorting mode)

Figure 8:
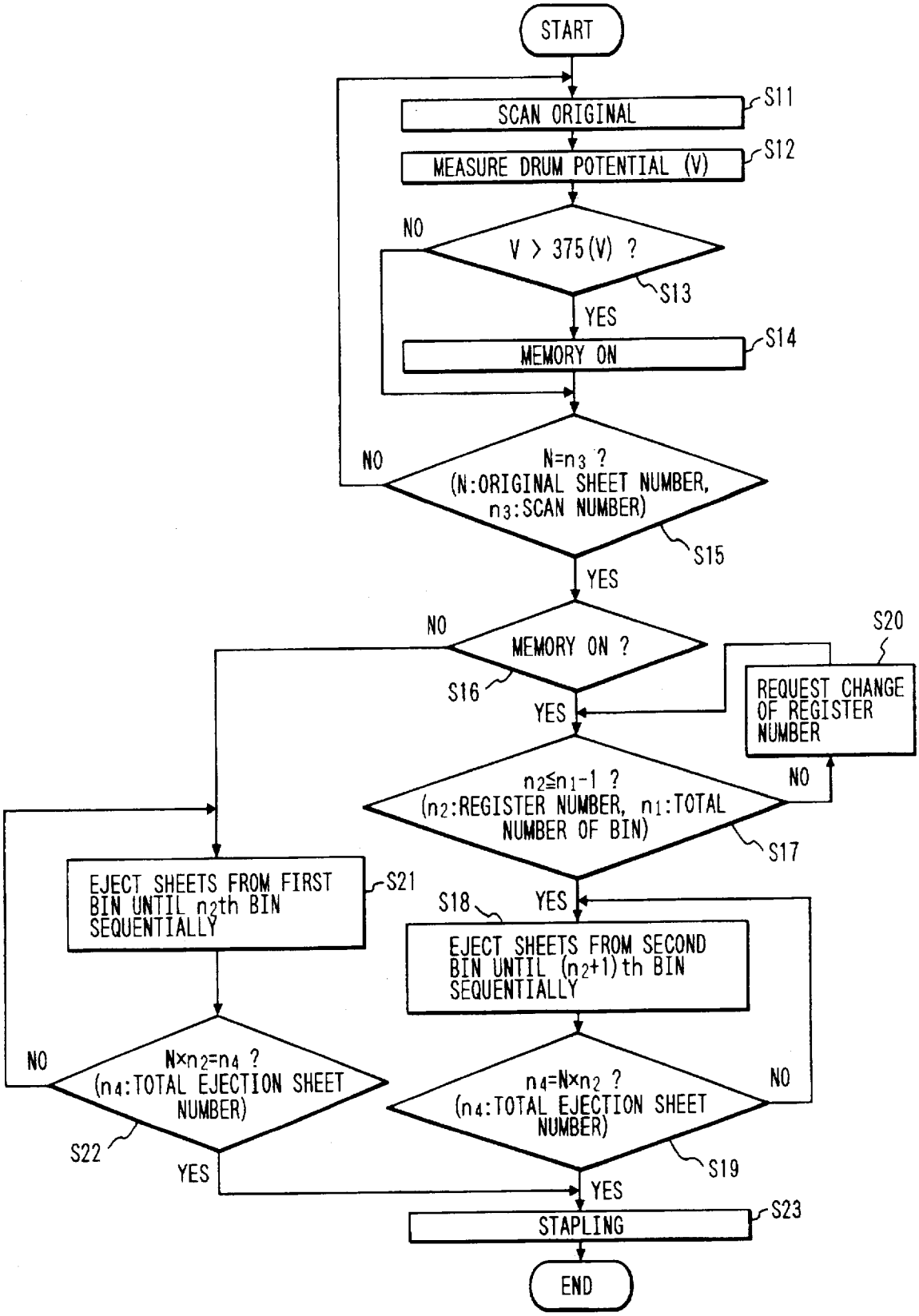
FIG. 8 is a flowchart for explaining the operation in a sorting mode of the image forming apparatus shown in FIG. 1.

The operation in the case where the sorting mode is selected will now be described with reference to FIG. 8.

When the sorting mode is selected, in a manner similar to the case mentioned above, the originals are sequentially conveyed onto the platen glass 213 by the ADF 300 and are sequentially prescanned and the drum potentials corresponding to the originals are sequentially measured (steps S11, S12). In the case where there is an original in which the drum potential is larger than the threshold value of 375V due to such a prescan, which number of original in the number N of all originals is set into a memory 1005 (refer to FIG. 5) and the memory 1005 is set to ON (steps S13, S14). Such a prescan is executed only the number of times corresponding to the number of originals, namely, until the number (n) of scans coincides with the number N of originals (step S15).

Figure 13:
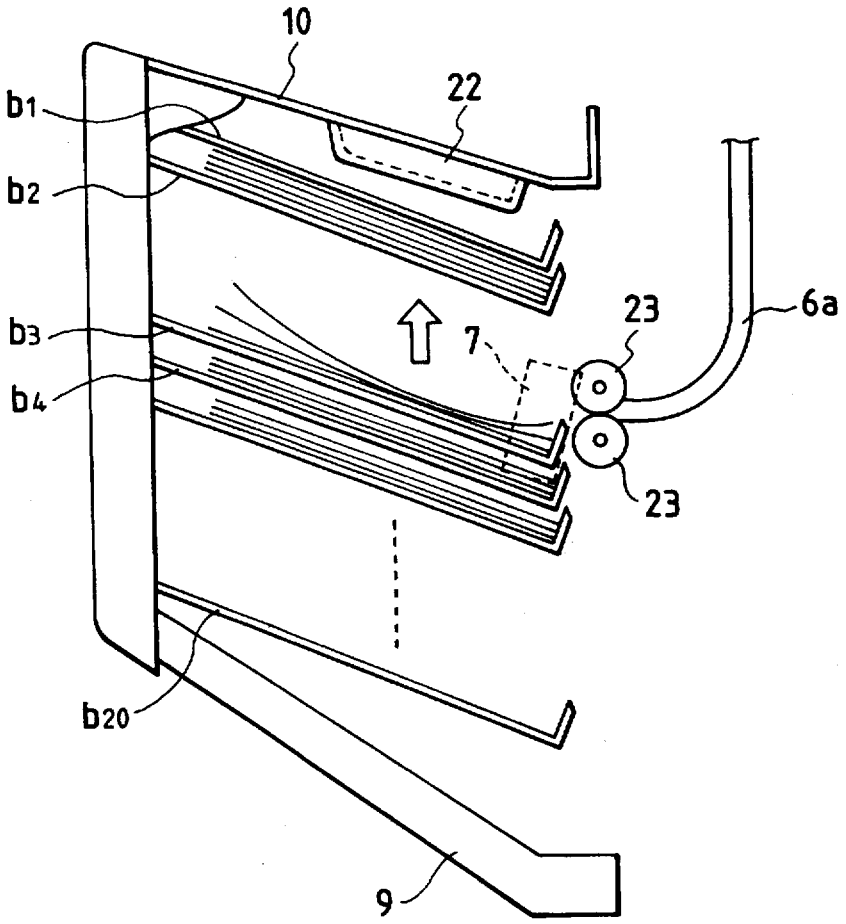
FIG. 13 is a side elevational view of a main section for explaining a state in which a curled portion of a sheet is depressed in the sorting mode of the image forming apparatus shown in FIG. 1.

After all of the originals were prescanned, when the memory 1005 is ON (step S16), if the relation between a register number (the number of copies) $n_2$ and the total number $n_1$ of bin trays (b) ($n_1$=20 in the embodiment) satisfies $[n_2 \leqq (n_1-1)]$ (step S7), the bin trays of the register number $n_2$ from the second bin tray b2 to the $(n_2+1)$th bin tray $b(n_2+1)$ are used and the copied sheets are sequentially sorted to each bin tray (step S18). The sorting operation is executed until the sheets of one original (one register number) is ejected to each bin and the total number $n_4$ of sheets to be ejected out reaches $(N \times n_2)$ (step S19). In such a sorting operation, as shown in FIG. 13, the whole surface of the sheet ejected onto the bin tray is pressed by the lower surface of the bin tray locating over such a bin tray by one stage, so that a curl of the sheet is corrected to be reduced. In such a case, since the sheet is not ejected onto the first bin tray b1, the pressing member 22 to correct the curl of the sheet on the bin tray b1 doesn't need to be provided for the non-sort bin 10. When $n_2 > (n_1-1)$, a message for requesting to change the register number $n_2$ to $(n_1-1)$ or less is displayed (step S20). After the register number $n_2$ was changed to $(n_1-1)$, the bin trays from the second bin tray b2 to the $(n_2+1)$th bin tray $b(n_2+1)$ are used and the copied sheets are sequentially sorted onto each bin tray in a manner similar to the above.

On the other hand, when the memory 1005 is not ON, the bin trays from the first bin tray b1 to the $n_2$-th bin tray $b(n_2)$ are used and the copied sheets are sequentially sorted to each bin tray (steps S22, S23).

After completion of the sorting operation, the sheets on each bin tray are sequentially stapled by the stapler 7 (step S23).

(Non-sorting mode)

Figure 9:
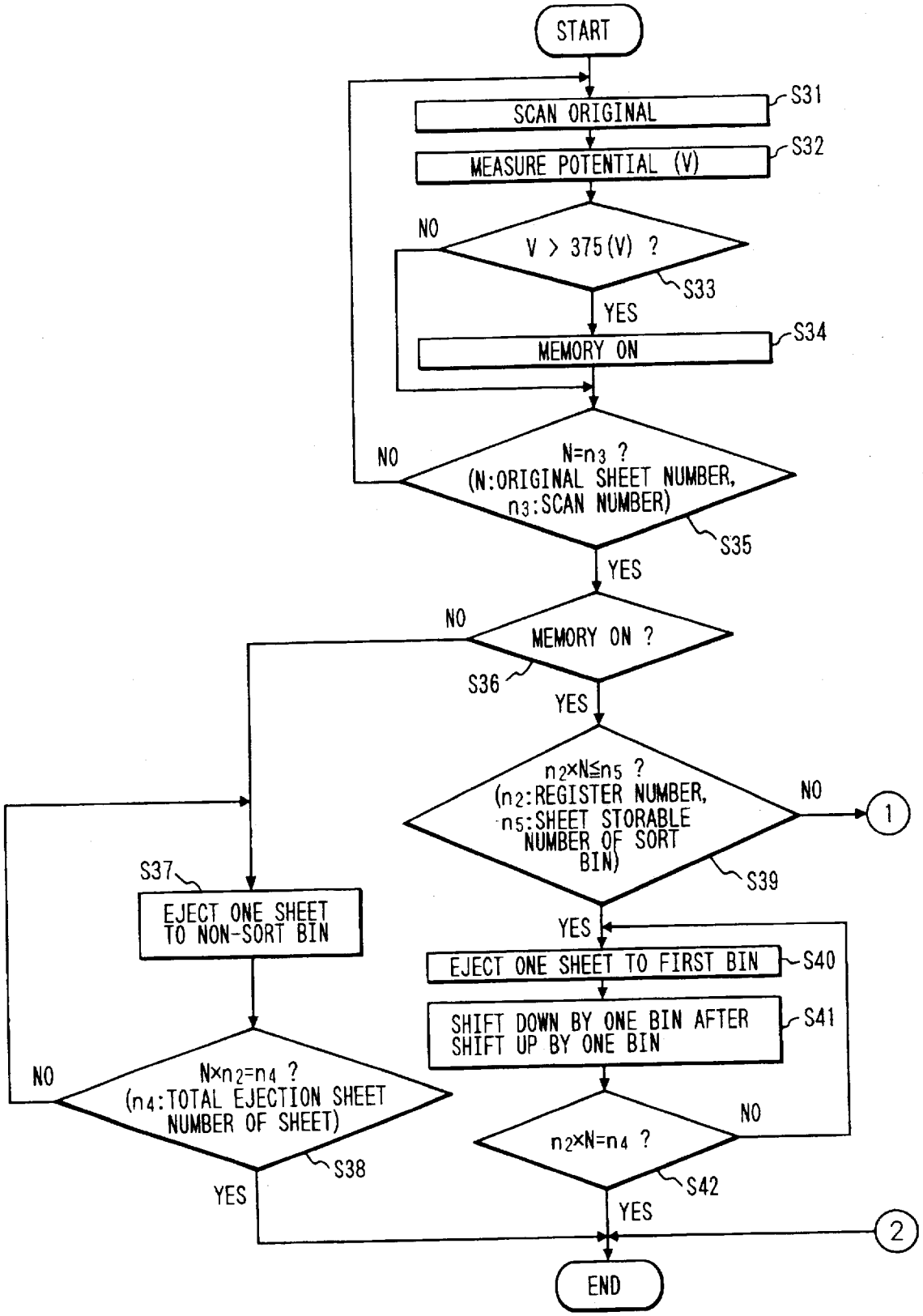
FIG. 9 is a flowchart for explaining the operation in a non-sorting mode of the image forming apparatus shown in FIG. 1.
Figure 10:
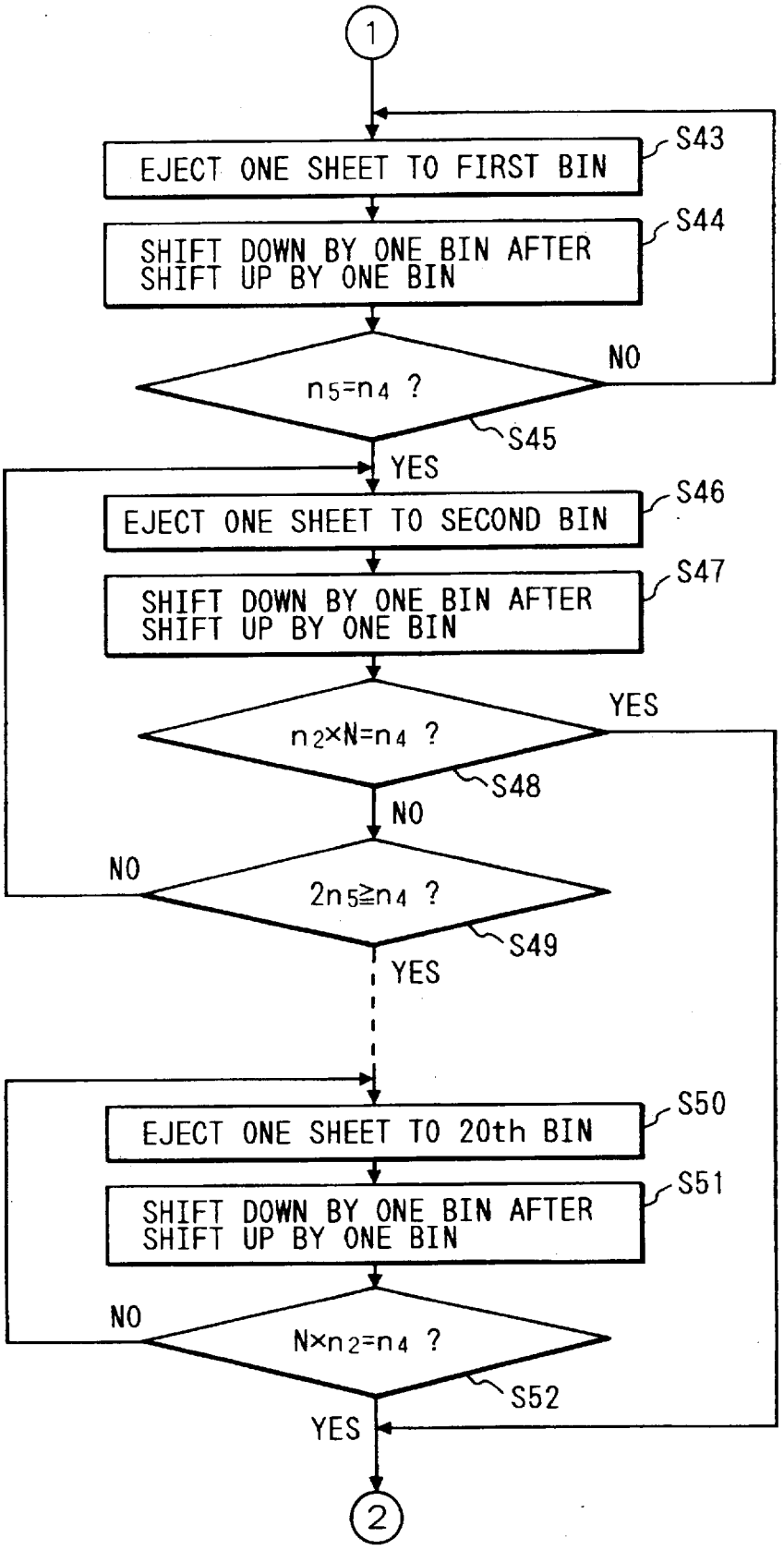
FIG. 10 is a flowchart for explaining the operation in a grouping mode of the image forming apparatus shown in FIG. 1.

The non-sorting mode will now be described with reference to FIGS. 9 and 10.

When the non-sorting mode is selected, in a manner similar to the sorting mode mentioned above, the originals are sequentially prescanned, the image density of each original is judged by comparing the drum potential with the threshold value of 375V, and the results are stored into the memory 1005 (steps S31 to S35). When the memory 1005 is not ON, since the curl amount of the sheet is small, the copied sheets are ejected out onto the non-sort bin 10 (steps S37, S38).

On the other hand, when the memory 1005 is ON, the number of sheets which can be enclosed to each sort bin (b) is set to $n_5$. When $(n_2 \times N) \leqq n_5$ (step S39), one copied sheet is first ejected out to the first bin tray b1. The bin group is temporarily shifted up by a distance of one bin by one rotation of the lead cam 4 in a manner similar to the foregoing one-copy staple sorting mode. The curl of the sheet on the first bin tray b1 is pressed by the pressing member 22. After that, the bin group is shifted down by a distance of one bin and is returned to the original state, namely, a state in which the sheets are ejected out onto the first bin tray b1 (step S41). In a manner similar to the above, the sheets of the number as many as the total number of copies until the $(n_2 \times N)$th sheet are ejected out onto the first bin tray b1 (step S42).

When $(n_2 \times N) > n_5$, namely, when the total number of copies is larger than the number $n_5$ of sheets which can be enclosed to one bin tray (b), in a manner similar to the foregoing case, $n_5$ sheets which can be enclosed are ejected out to the first bin b1 (steps S43, S44, S45). After that, up to $n_5$ sheets are ejected out onto the second bin tray b2 in a similar procedure (steps S46–S49). In a manner similar to the above, the sheets are ejected out to each bin after the third bin tray b3 until the total number $n_4$ of sheets to be ejected reaches the total number of copies ($n_2 \times N$), namely, until $n_4=(n_2 \times N)$. In FIG. 10, the processing steps of executing the ejecting operation to eject out the sheet from the third bin tray b3 to the 19th bin tray b19 is omitted and the ejecting operation of the sheet to the 20th bin tray b20 is executed in steps S50 to S52.

In the embodiment, among the copy papers (sheets) of the original, which number of sheet with a large curl amount can be stored in the memory 1005. Therefore, in the above non-sorting mode and the foregoing one-copy stapling mode, only when the copy sheet with a large curl amount is ejected out, the temporary shift-up operation can be also generally performed. The temporary shift-up or shift-down operation can be also performed each time a predetermined number of copy papers are ejected out instead of every ejection of one sheet.

(Grouping mode)

A grouping mode will now be described with reference to FIGS. 11A, 11B, 12A and 12B.

When the grouping mode is selected, in a manner similar to the sorting mode or non-sorting mode mentioned above, the originals are sequentially prescanned, the image density of each original is judged by comparing the drum potential with the threshold value of 375V, and the results are stored into the memory 1005 (steps S61–S66).

When the memory 1005 is not ON, since the curl amount of the sheet is small, one bin is used per one original and the copied sheets are ejected out onto each bin every number of sheets as many as the register number $n_2$ (steps S67–S69). Therefore, the sheets of every register number $n_2$ are stacked to the bin trays from the first bin tray b1 to the N-th bin tray bN.

Figures 11, 11A:
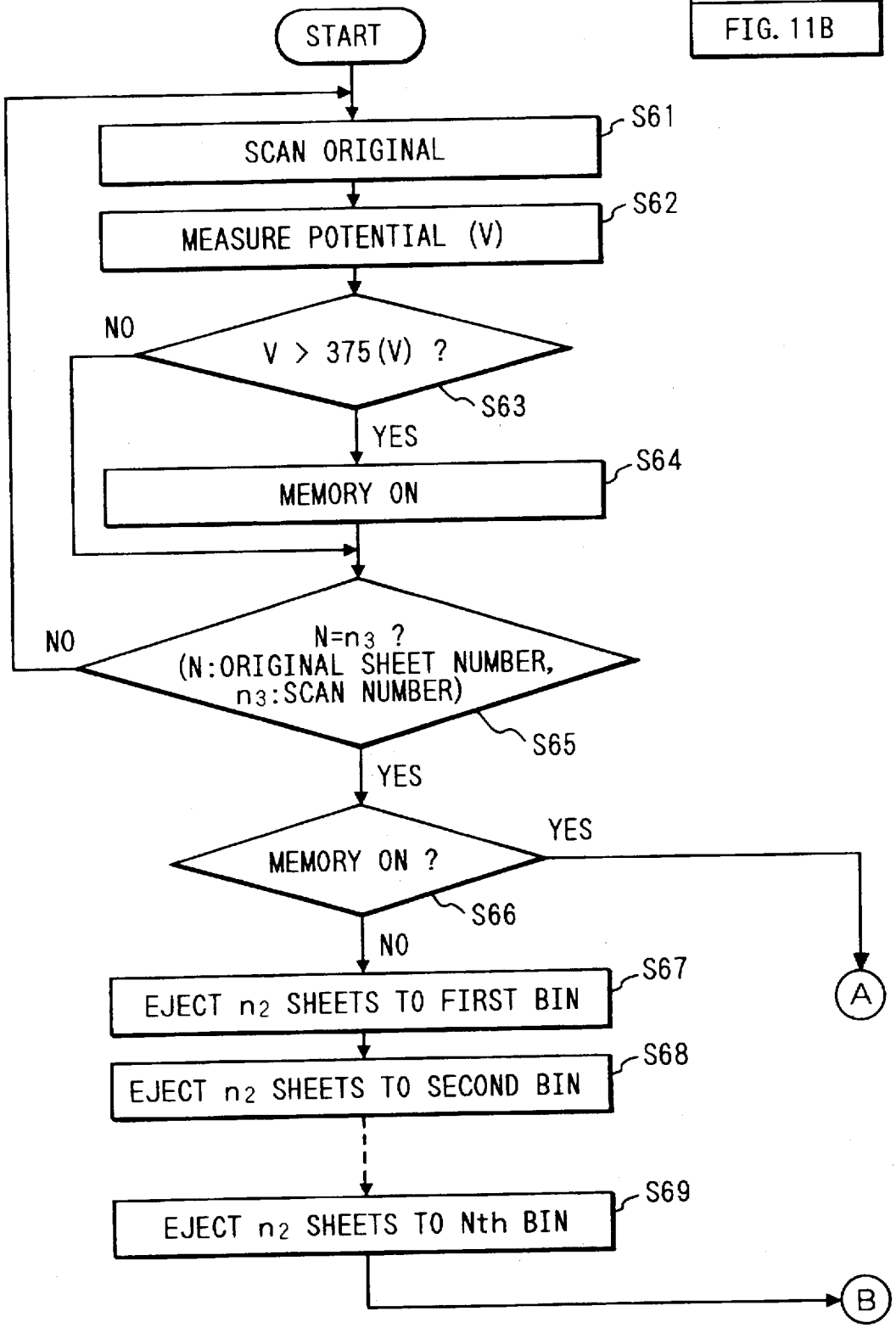
FIG. 11 which comprised of FIGS. 11A and 11B is a flowchart for explaining the operation in the grouping mode of the image forming apparatus shown in FIG. 1.
Figure 11B:
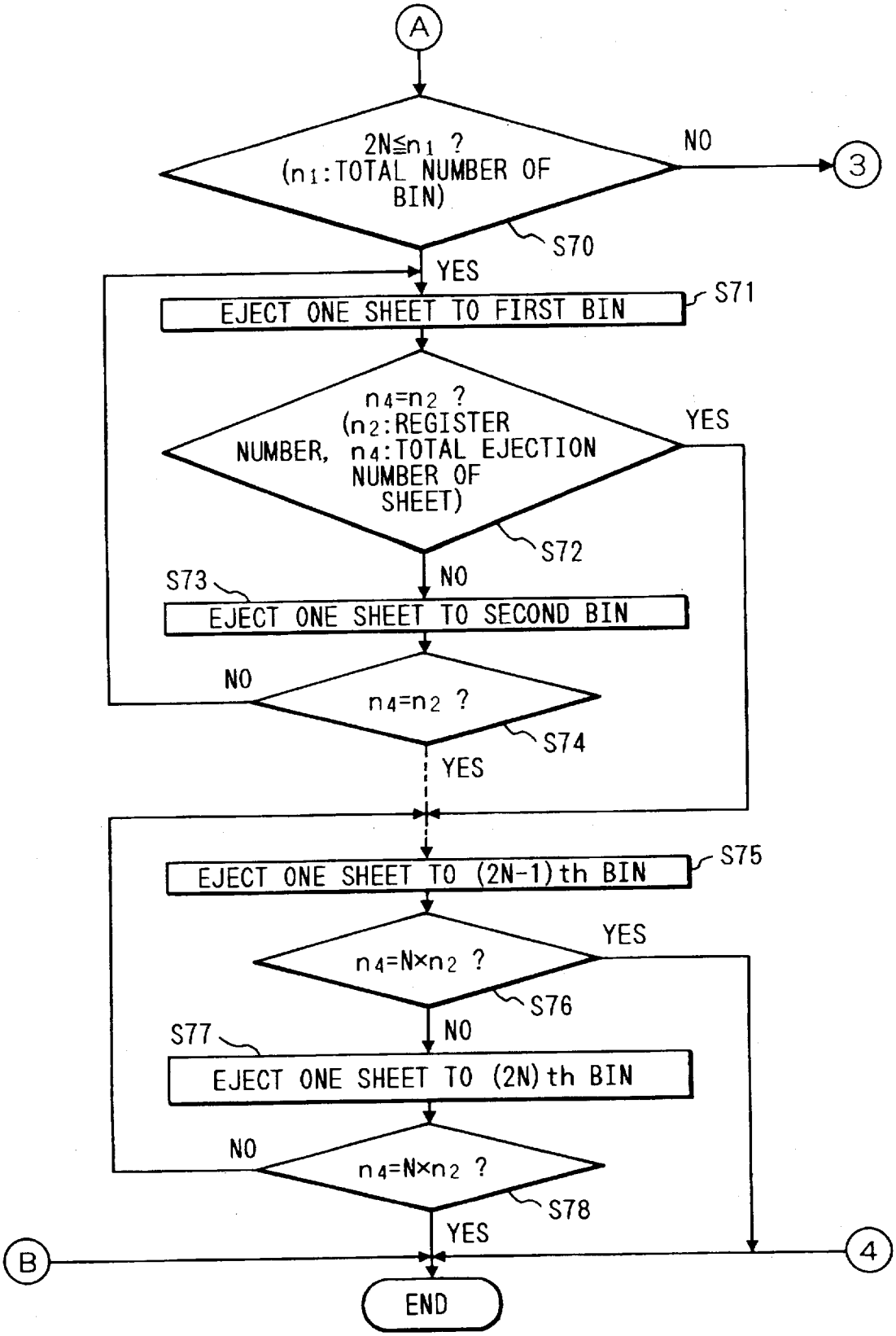

On the other hand, when the memory 1005 is ON, if the relation between the number N of originals and the total number $n_1$ of bins ($n_1=20$) satisfies ($2N \leqq n_1$) (step S70), after one copy sheet (copied sheet) of the first original was ejected out to the first bin tray b1, the bin group is shifted up by a distance of one bin. The next copy sheet of the first original is ejected to the second bin tray b2. After that, the bin group is shifted down by a distance of one bin. The next copy sheet of the first original is again ejected out to the first bin tray b1. In a manner similar to the above, the copy sheets of the number as many as the register number $n_2$ of the first original are alternately separately stacked onto the first and second bin trays b1 and b2. By repeating the shift-up and shift-down of the bin group, the curled portions of the copy sheets on the first and second bin trays b1 and b2 are depressed. Subsequently, the copy sheets of the second original are similarly alternately separately stacked onto the third and fourth bin trays b3 and b4. In a manner similar to the above, the copy sheets of every original are separately stacked to every two bin trays. The copy sheets of the N-th original are separately stacked onto the (2N−1)th bin tray b(2N−1) and the 2N-th bin tray b(2N) in steps S75 to S78. In FIGS. 11A and 11B, the processing steps of the stacking operations of the copy sheets of the originals from the second original to the (N−1)th original are omitted.

Figures 12, 12A:
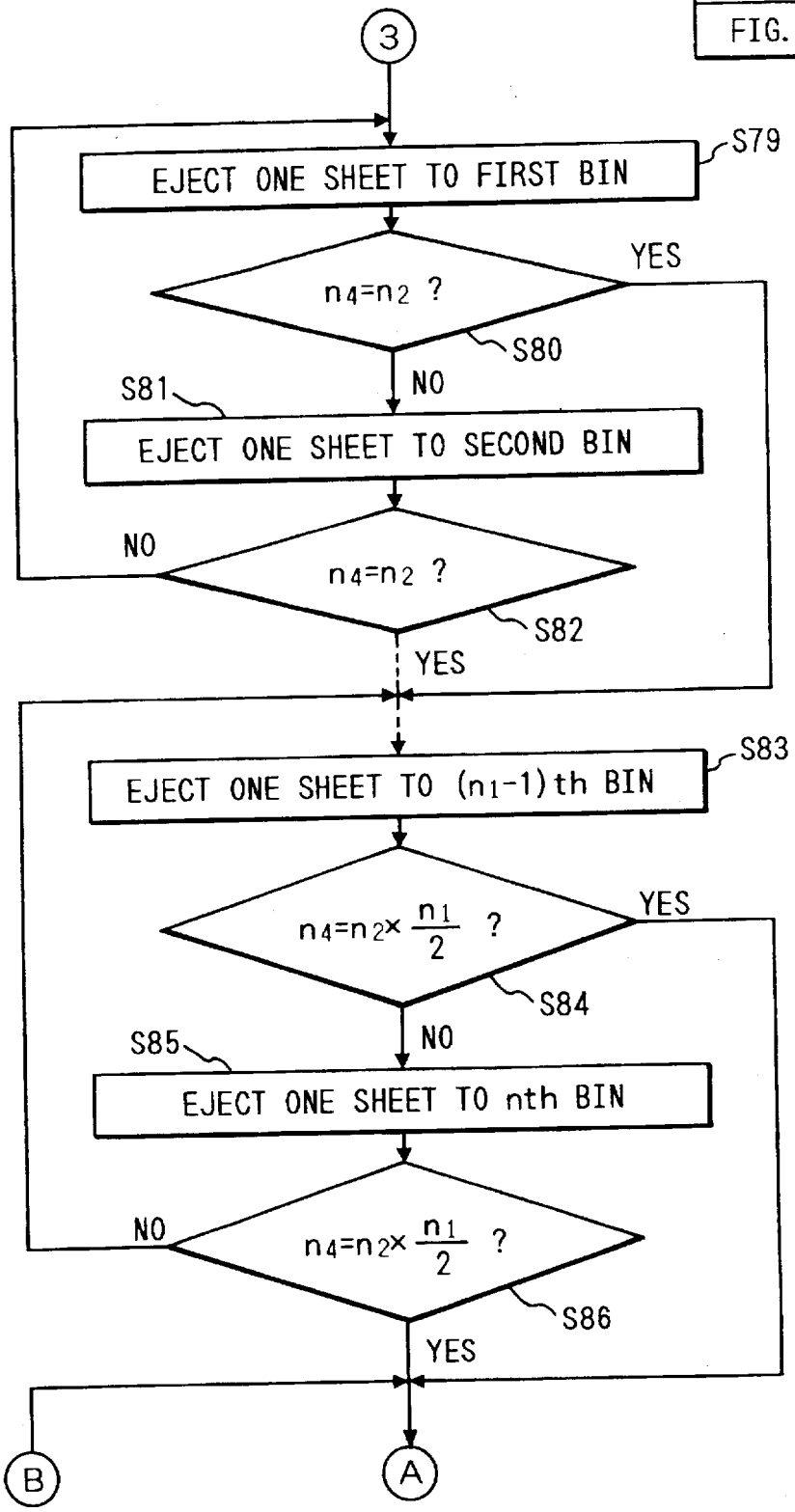
FIG. 12 which comprised of FIGS. 12A and 12B is a flowchart for explaining the operation in the grouping mode of the image forming apparatus shown in FIG. 1.
Figure 12B:
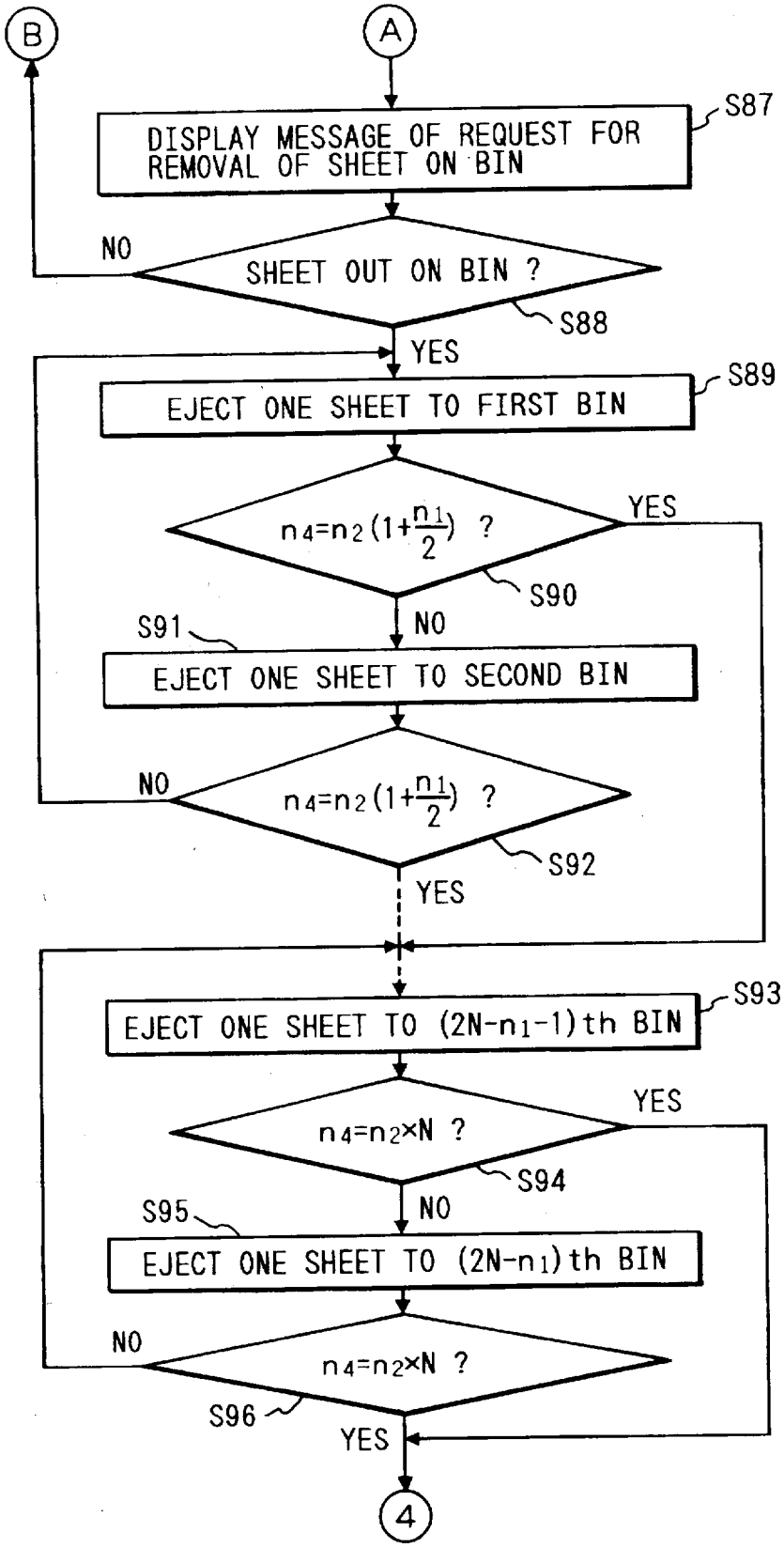

When $2N>n_1$, first, in a manner similar to the foregoing case, in steps S79 to S86, the copy sheets of ($\frac{1}{2} \cdot n_1$) originals, namely, the copy sheets of ten originals from the first original to the tenth original because ($n_1=20$) in the embodiment are stacked to the bins from the first bin to the 20th bin. After that, the apparatus enters a standby state and a message for requesting a removal of the sheets on the bin is displayed (step S87) to the console unit (not shown). In each of the above embodiments, a hole 25 (refer to FIG. 3) is formed in each bin tray (b). A pair of photosensors 26*a* and 26*b* of the transmitting type are attached to the non-sort bin 10 and bin frame 9 so as to form an optical path passing through the holes 25. The presence or absence of the sheet on the bin tray (b) is detected by a sheet detecting sensor formed by such a pair of photosensors 26*a* and 26*b*. In step S88, when all of the sheets on the bin tray (b) are eliminated and the absence of the sheets is detected by the sheet detecting sensor, the copy sheets of the eleventh original are automatically alternately stacked by using the first and second bins in steps S89 to S92 by a procedure similar to that mentioned above. In a manner similar to the above, the copy sheets of the N-th original are alternately stacked by using the ($2N-n_1-1$)th bin and the ($2N-n_1$)th bin. At a time point when the total number $n_4$ of ejected sheets reaches ($n_2 \times N$), the ejection of the sheets is completed (steps S93 to S96). In FIGS. 12A and 12B, the processing steps of the stacking operation of the copy sheets of the originals from the 11th original to the (N−1)th original are omitted.

In the embodiment, although two bins have been used per one original, even by using two or more bins per one original, the curled sheets can be also sufficiently stacked while pressing the curled sheets.

[Second embodiment]

The second embodiment will now be described with reference to FIG. 14.

Figure 14:
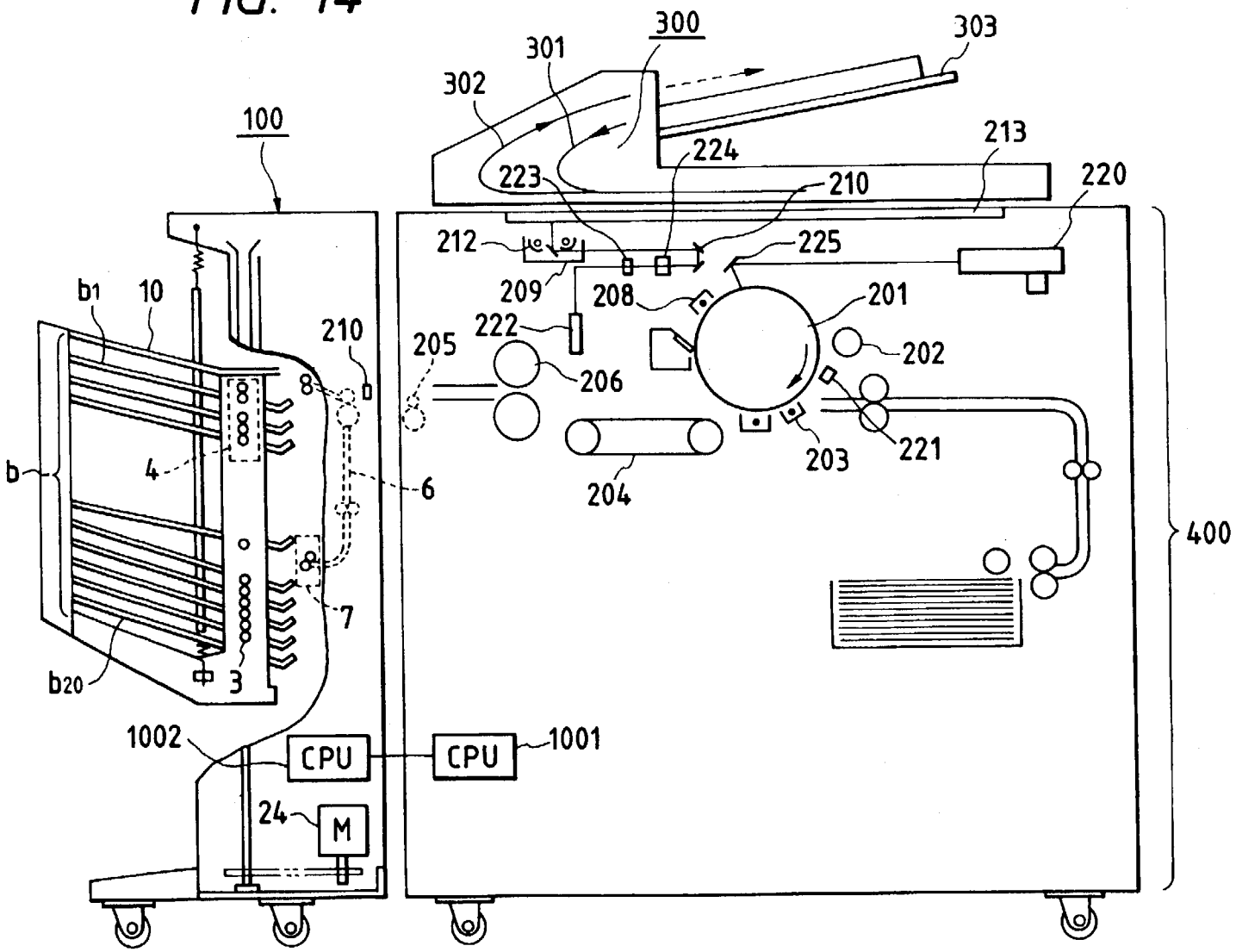
FIG. 14 is a schematic constructional diagram showing a whole image forming apparatus of the second embodiment of the invention.

In FIG. 14, reference numeral 400 denotes a digital copying machine. Image information of an original scanned by a first mirror plate 209 and a second mirror plate 210 is irradiated to a CCD sensor 223 by a condenser lens 224 and is stored into a memory 222. Reference numeral 220 denotes a laser scanner having a polygon mirror (not shown). The laser scanner forms a latent image corresponding to the image information onto the drum 201 through a turn-over mirror 225. The developing, transferring, separating, and fixing processes are fundamentally similar to the foregoing embodiment.

The CCD sensor 223 has a resolution of eight bits and can discriminate the density of the image at 256 stages. In the embodiment, a value of "0" is set to the smallest density and a value of "256" is set to the largest density.

Figure 15:
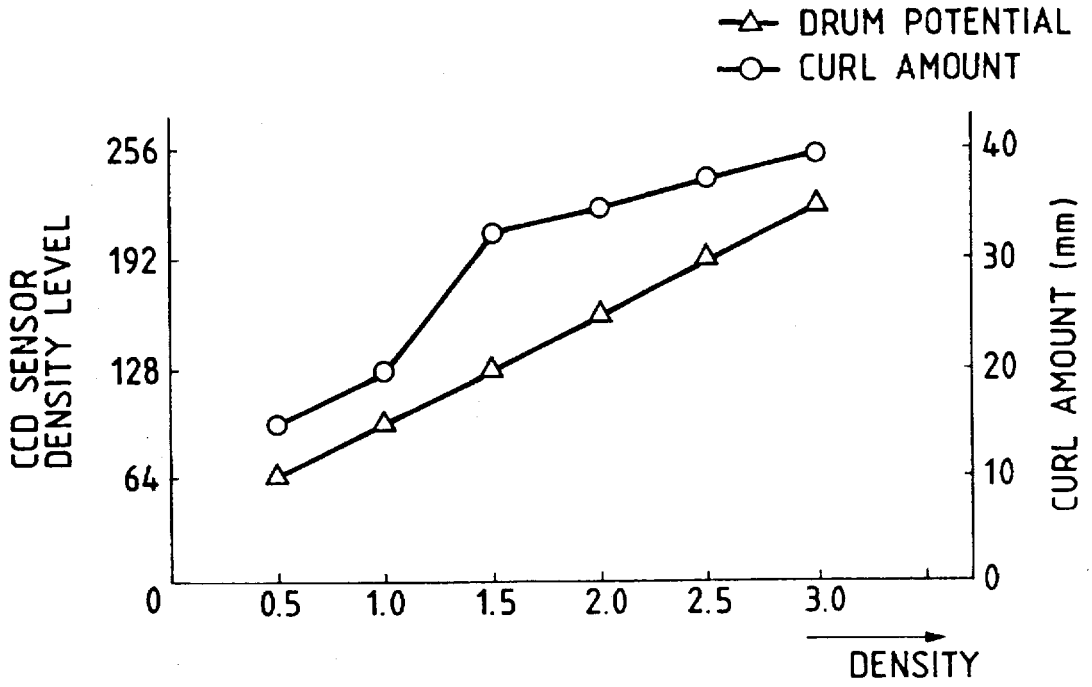
FIG. 15 is a diagram showing the correlations among the detection signal of a CCD sensor shown in FIG. 14, the image density, and the curl amount of a sheet.
Figure 16:
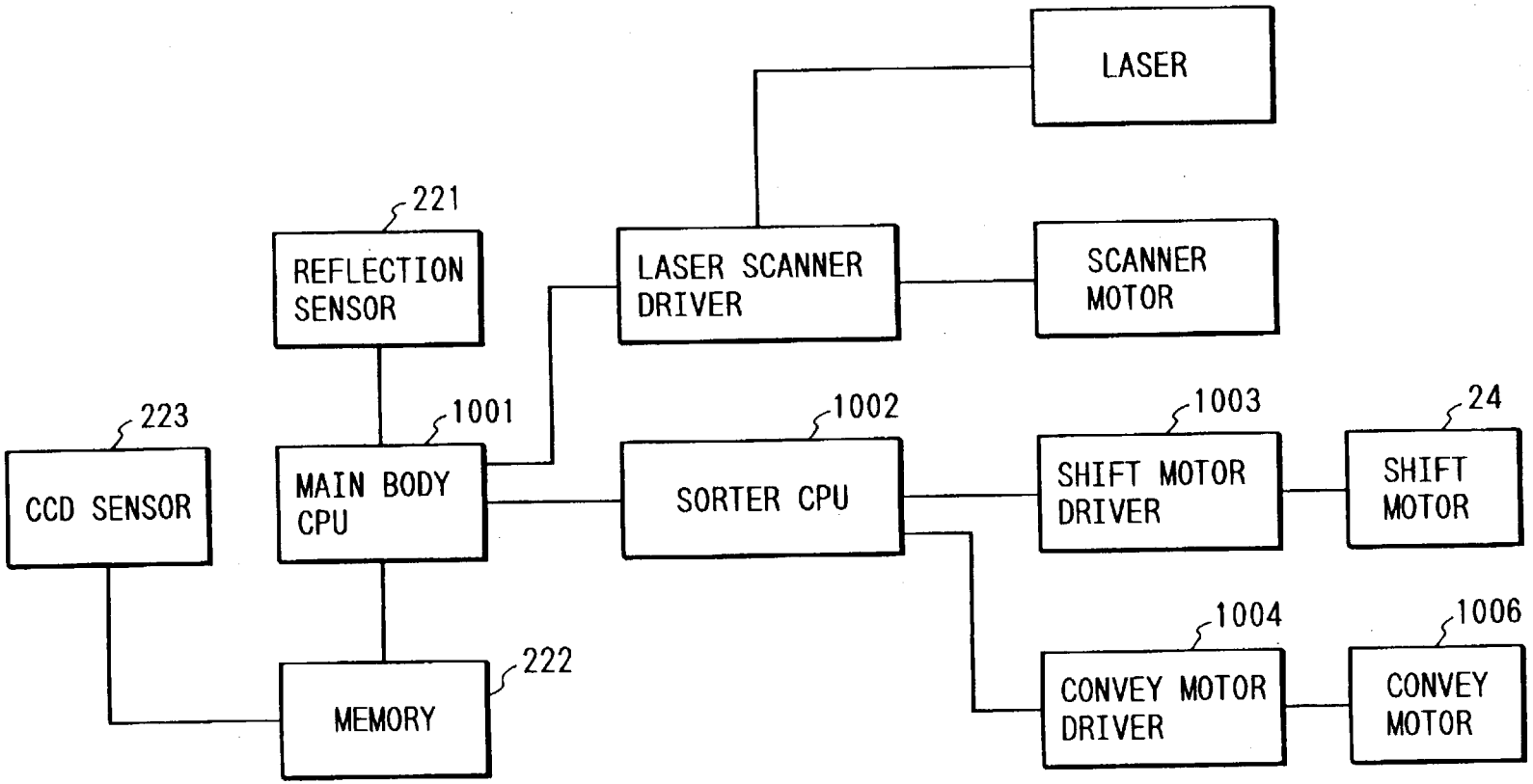
FIG. 16 is a block constructional diagram of the image forming apparatus shown in FIG. 14.

FIG. 15 is a diagram showing the correlations among the image density, the detection level of the CCD sensor 223, and the curl amount according to experiments. A detection signal of the image density level from the CCD sensor 223 is sent to the main body CPU 1001 through the memory 222 shown in FIG. 16. The detection signal is supplied from the main body CPU 1001 to the sorter CPU 1002 and is compared with a predetermined threshold value by the sorter CPU 1002. When the value of the detection signal is larger than the threshold value, driving signals are supplied from the sorter CPU 1002 to the shift motor driver 1003 and convey motor driver 1004, thereby making the shift motor 24 and a convey motor 1006 operative. In the embodiment, since the height (l) of the rear edge receiving portion of the bin tray (b) is set to a value so that the sheet of a curl amount of up to 20 mm can be stacked, the threshold value is set to an image density level of 128 (refer to FIG. 15).

[Third embodiment]

Figure 17:
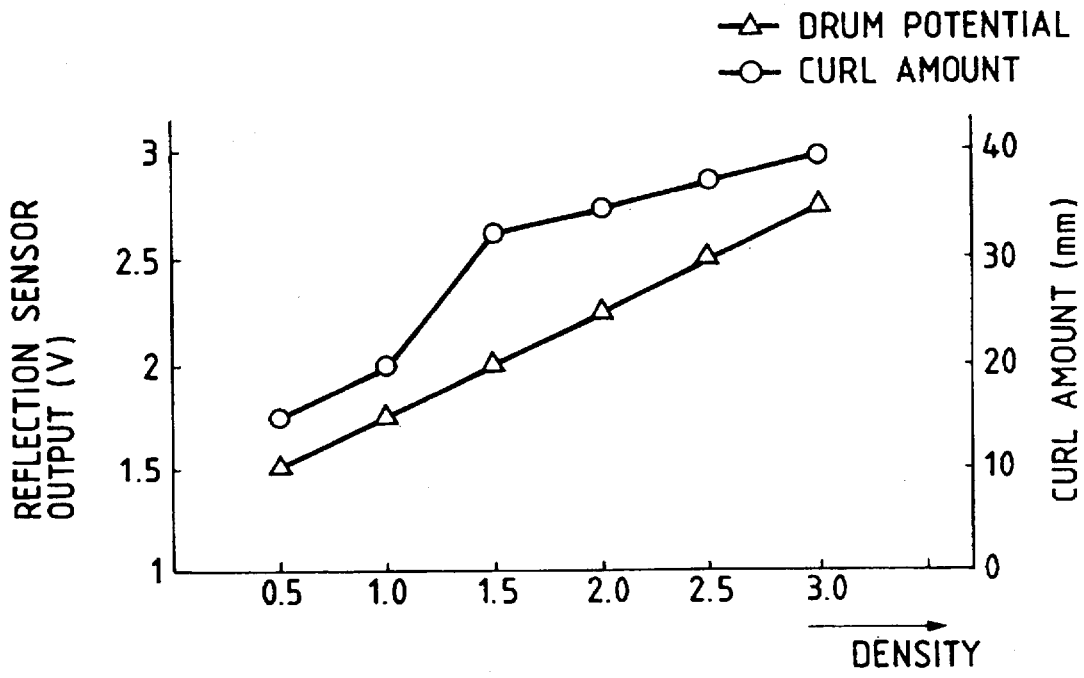
FIG. 17 is a diagram showing the correlations among the detection signal of a reflecting type sensor provided for an image forming apparatus according to the third embodiment of the invention, the image density, and the curl amount of a sheet.

In the embodiment, as shown in FIG. 14, a reflection sensor 221 to detect a density of the toner image formed on the drum 201 is used. In the embodiment, an output of the reflection sensor 221 is used in a range from 1V to 3V (refer to FIG. 17). The output is set to 3V in case of the largest image density and is set to 1V in case of the smallest density. The output is compared with the threshold value of 2V, thereby discriminating whether image density is equal to or larger than a predetermined density or not. Therefore, an ejecting sequence in the sorting mode, grouping mode, and non-sorting mode can be executed on the basis of the output of the reflection sensor 221 in a manner similar to the foregoing embodiment. It will be obviously understood that even when the reflection sensor 221 is arranged on the paper path after the image transfer so as to detect the image density of the copy sheet after the image transfer, there is an effect in the one-copy staple sorting mode.

Figure 18:
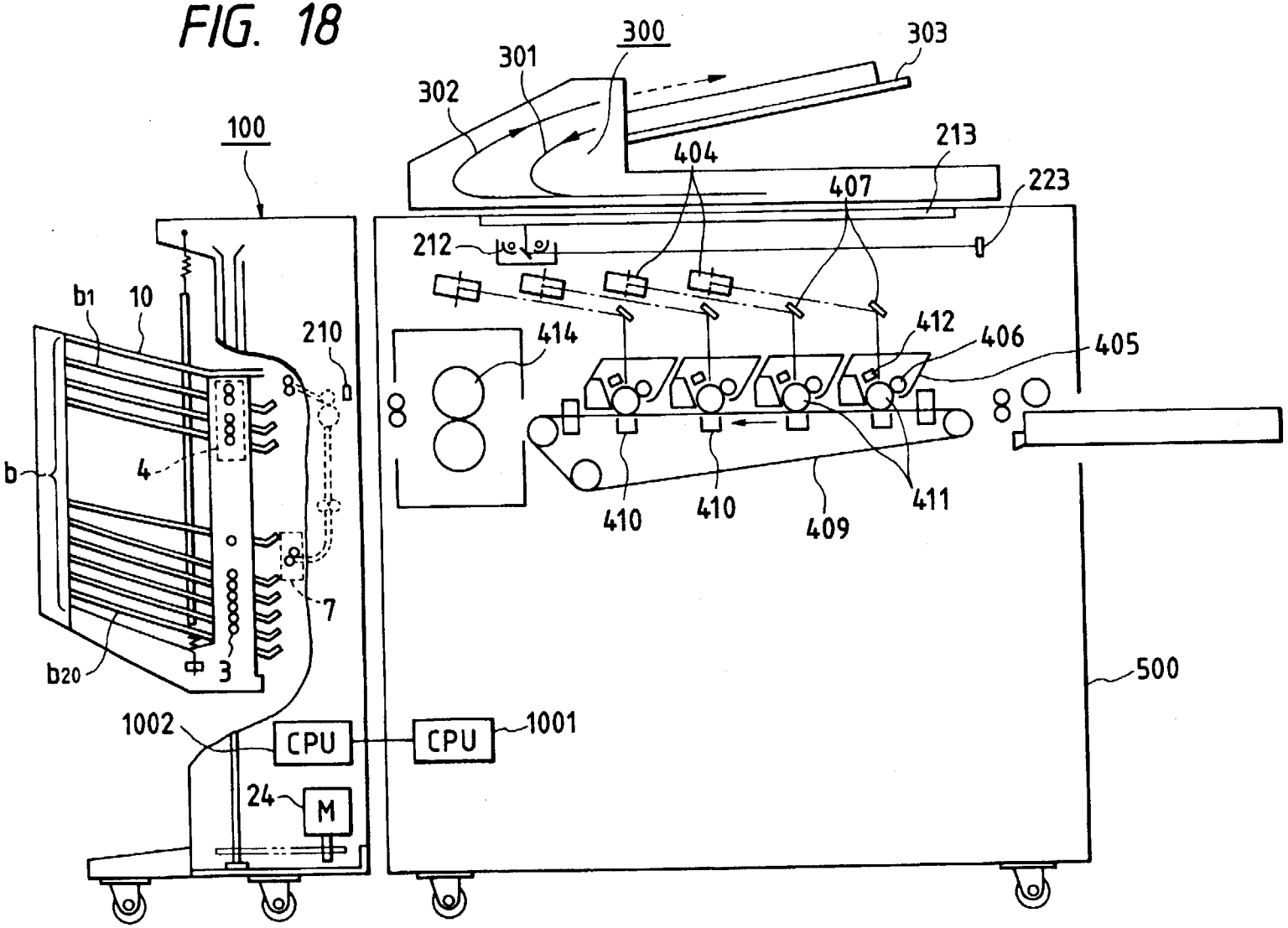
FIG. 18 is a constructional diagram of a color image forming apparatus according to another embodiment of the invention.
Figure 19A:
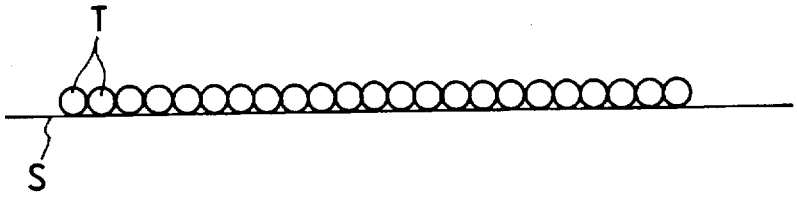
FIGS. 19A and 19B are explanatory diagrams of a an state in which a sheet on which an image was formed is curled.
Figure 19B:
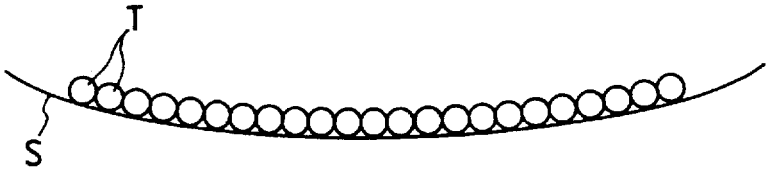
Figure 20A:
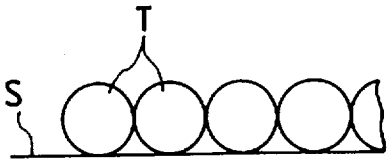
FIGS. 20A and 20B are enlarged diagrams of a main portion in FIGS. 19A and 19B.
Figure 20B:
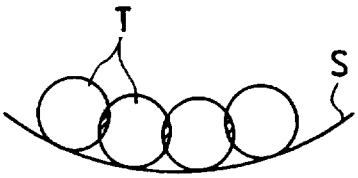
Figure 21:
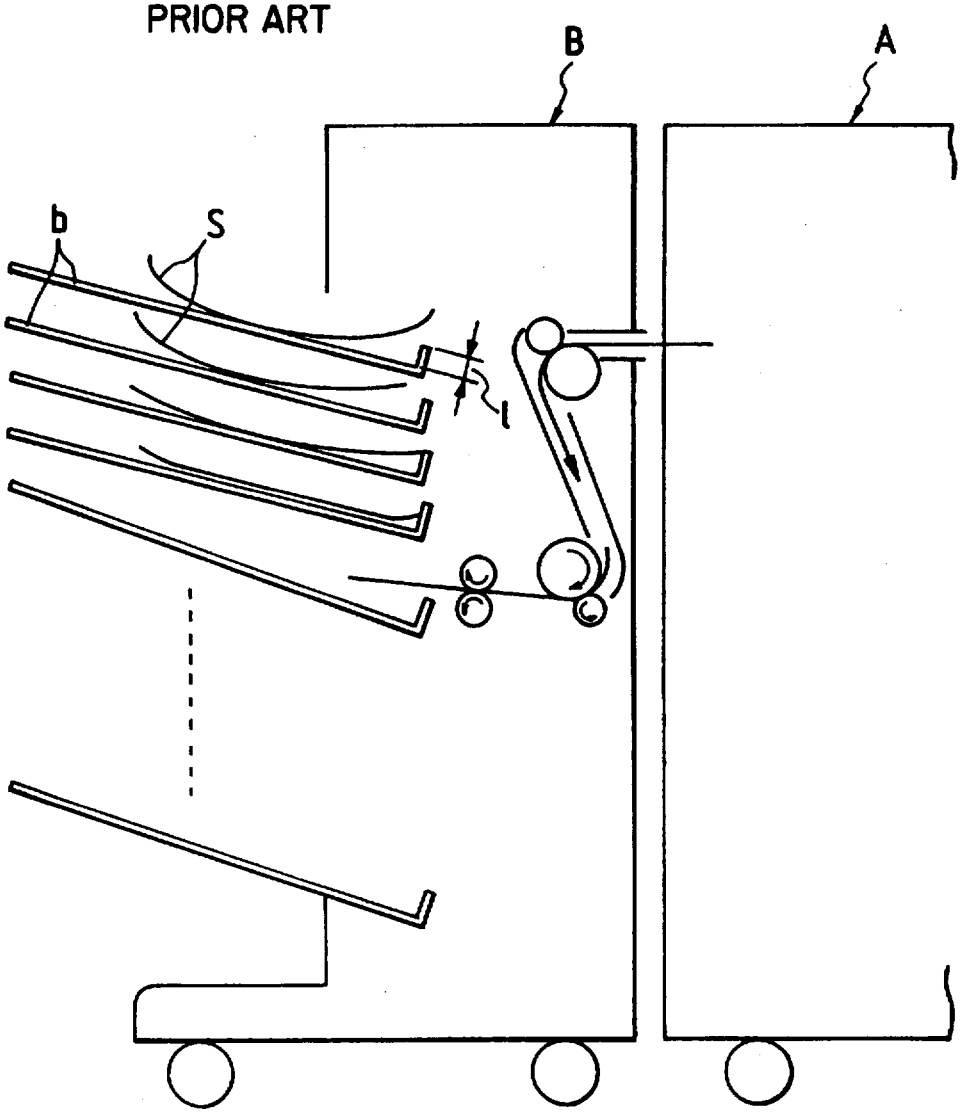
FIG. 21 PRIOR ART
FIG. 21 is a side elevational view of a main section of a conventional image forming apparatus.
Figure 22:
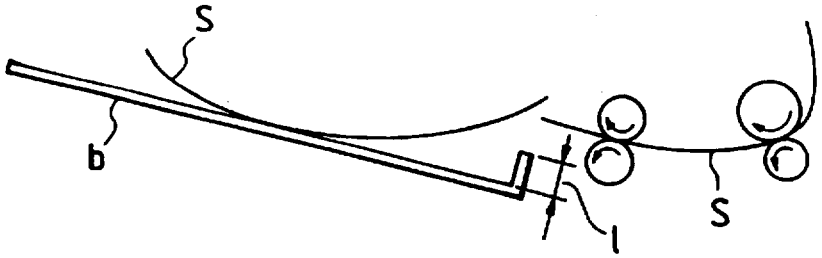
FIG. 22 PRIOR ART
FIG. 22 is an enlarged diagram of a main section of FIG. 21.

FIG. 18 is a diagram showing a color copying machine 500 to which the sorting apparatus 100 of the construction and operation mentioned above is connected. Since the platen glass 213 and optical system 212 operate as mentioned above, their descriptions are omitted here. The CCD sensor 223 can read a full-color original.

The sheet is fed into the printer from a cassette by a feed roller which is rotated by a feed roller driving motor (not shown) and is supplied onto a conveying belt 409 to convey the sheet.

The conveying belt 409 is constructed as an endless belt and is supported by three rollers. When a belt driving motor (not shown) is rotated by a belt driving roller, the conveying belt 409 is driven in the direction shown by an arrow, thereby conveying the sheet put on the belt to the left in the diagram.

On the other hand, four photosensitive drums 411 are arranged on the conveying path of the sheet by the conveying belt 409 at predetermined intervals in the conveying direction. One charging unit 412, one toner hopper 405, one developing sleeve 406, and one transfer unit 410 are provided for each of the photosensitive drums 411. Toners of four different colors of cyan, magenta, yellow, and black shown at C, M, Y, and BL are stored in the toner hoppers 405.

An optical system comprising a laser oscillator (not shown), a polygon mirror 404, and a reflecting mirror 407 is provided for each of the photosensitive drums 411. With respect to each of the four units as mentioned above, in the recording mode, the photosensitive drum 411 is first rotated clockwise in the diagram and is uniformly charged by the charging unit 412. A laser beam which is turned on or off in accordance with the pixel inputted from the CCD sensor 223 is generated from the laser oscillator. The laser beam is swung in the main scanning direction (axial direction of the drum) on the surface of the photosensitive drum 411 through the reflecting mirror 407 by the polygon mirror 404 which is rotated at a high speed, thereby performing the main scan. Thus, an electrostatic latent image is formed on the drum surface. Subsequently, the toner is deposited onto the drum surface by the developing sleeve 406 and the toner image corresponding to the latent image is formed. Further, the toner image is transferred by the transfer unit 410 onto the sheet which passes between the photosensitive drum 411 and the transfer unit 410.

During the processes in which the sheet is conveyed by the conveying belt 409 and passes on the four photosensitive drums 411, the toner images of four colors are transferred to the sheet as mentioned above. After completion of the transfer, the sheet is guided between a heat roller 114 of a fixing unit 113 and a pressure contact roller 122 and the toner images are thermally fixed by the heat roller 114. After that, the sheet is ejected out toward the sorting apparatus 100 by the ejecting roller. As mentioned above, a full-color copy is executed. Since the sheet ejected out from such a color copying machine 500 is pressed as mentioned above by the bin of the sorting apparatus 100, the curl of the sheet which occurs in the full-color copy which is likely to increase the amounts of toners to be transferred onto the sheet can be reduced.

What is claimed is:

1. An image recording apparatus comprising:

recording means of an electrophotographic type for recording an image onto a sheet;

stacking means having a plurality of trays, for stacking the sheet onto which the image is recorded by said recording means; and drive means for driving said stacking means to change a distance between a single tray onto which the sheet is to be stacked and its upwardly neighboring tray, wherein when a plurality of sheets constituting one group is continuously stacked onto the single tray, said drive means reduces said distance for a predetermined time and then an operation for widening said distance is effected at least once until the stacking of said sheets constituting one group onto the single tray is finished.

2. An apparatus according to claim 1, wherein said plurality of trays are vertically arranged.

3. An apparatus according to claim 2, wherein each time one sheet is stacked onto the tray, said single tray is moved upward and, after the elapse of a predetermined time, said single tray is moved downward.

4. An apparatus according to claim 1, wherein said recording means records a color image.

5. An apparatus according to claim 1, wherein when the sheet is transported to the single tray, said distance is widened by said drive means.

6. An apparatus according to claim 1, wherein sorting is possible by said plurality of trays.

7. A recording apparatus comprising:

recording means of an electrophotographic type for copying an image onto a sheet;

judging means for judging a density of the image which is recorded by said recording means;

stacking means including a plurality of movable trays for stacking the sheet onto which the image is recorded by said recording means; and driving means for driving said tray so as to move said stacking means, wherein in the case where a judgment result of said judging means indicates a predetermined density or more, said driving means widens a distance between the tray to which the sheet is stacked and the tray adjacent to said tray and, after the sheet was stacked to the tray, said driving means reduces the distance between the tray to which the sheet was stacked and the tray adjacent to said tray.

8. An apparatus according to claim 7, wherein said plurality of trays are vertically arranged.

9. An apparatus according to claim 7, wherein by vertically moving said plurality of trays, the distance between the trays is changed and the tray to stack the sheet is changed.

10. An apparatus according to claim 9, wherein each time a predetermined number of sheets are stacked to the tray, said plurality of trays are moved upward and, after the elapse of a predetermined time, said plurality of trays are moved downward.

11. An apparatus according to claim 10, wherein each time one sheet is stacked to the tray, the vertical movement of said plurality of trays is executed.

12. An apparatus according to claim 7, wherein said recording means has a photosensitive material, and said judging means judges the density of the image on the basis of a surface potential of said photosensitive material.

13. A sorter apparatus which is associated with a recording apparatus of an electrophotographic type for recording an image onto a sheet, comprising:

stacking means having a plurality of trays, for stacking the sheet onto which the image is recorded; and drive means for driving said stacking means to change a distance between the tray onto which the sheet is to be stacked and its upwardly neighboring tray, wherein when a plurality of sheets constituting one group are continuously stacked onto the single tray, said drive means reduces said distance for a predetermined time and then an operation for widening said distance is effected at least one time until the stacking of said sheets constituting one group onto the single tray is finished.

14. An apparatus according to claim 13, wherein said plurality of trays are vertically arranged.

15. An apparatus according to claim 14, wherein each time one sheet is stacked onto the tray, said single tray is moved upward and, after the elapse of a predetermined time, said single tray is moved downward.

16. An apparatus according to claim 13, wherein when the sheet is transported to the single tray, said distance is widened by said drive means.

17. An apparatus according to claim 13, wherein the sorting is possible by said plurality of trays.

18. A sheet stacking method comprising the steps of:

stacking a sheet onto which an image is recorded onto one of a plurality of trays;

driving said stacking means to change a distance between the tray onto the sheet is to be stacked and its upwardly neighboring tray; and when a plurality of sheets constituting one group are continuously stacked onto the single tray, reducing said distance for a predetermined time and then an operation for widening said distance is effected at least once until the stacking of said plurality of sheets constituting one group onto the single tray is finished.

19. A method according to claim 18, further comprising the step of moving upward said single tray and moving downward said single tray after the elapse of a predetermined time each time one sheet is stacked onto the tray.

20. An image recording apparatus comprising:

recording means of an electrophotographic type for recording an image onto a sheet;

stacking means having a plurality of trays, for stacking a sheet onto which an image is recorded by said recording means; and drive means for driving said stacking means to change a distance between a single tray onto which the sheet is to be stacked and its upwardly neighboring tray, wherein when a plurality of sheets is continuously stacked onto the single tray, said drive means reduces said distance for a period of time and then an operation for widening said distance is effected at least once while said sheets are stacked onto the single tray.

21. An apparatus according to claim 20, wherein said recording means records a color image.

22. An apparatus according to claim 20, wherein when the sheet is transported to the single tray, said distance is widened by said drive means.

23. An apparatus according to claim 20, wherein said plurality of trays are capable of sorting.

24. A sorter apparatus which is associated with a recording apparatus of an electrophotographic type for recording an image onto a sheet, comprising:

stacking means having a plurality of trays, for stacking a sheet onto which an image is recorded; and drive means for driving said stacking means to change a distance between the tray onto which the sheet is to be stacked and its upwardly neighboring tray, wherein when a plurality of sheets are continuously stacked onto the single tray, said drive means reduces said distance for a period of time and then an operation for widening said distance is effected at least one time while said sheets are stacked onto the single tray.

25. An apparatus according to claim 24, wherein when the sheet is transported to the single tray, said distance is widened by said drive means.

26. A sheet stacking method comprising the steps of:

stacking a sheet onto which an image is recorded onto one of a plurality of trays;

changing a distance between the tray onto the sheet is to be stacked and its upwardly neighboring tray; and when a plurality of sheets are continuously stacked onto the single tray, reducing said distance for a period of time and then widening said distance at least once while said plurality of sheets are stacked onto the single tray.

* * * * *

UNITED STATES PATENT AND TRADEMARK OFFICE

CERTIFICATE OF CORRECTION

PATENT NO. : 5,722,030
DATED : February 24, 1998
INVENTOR(S) : Katsuhito KATO

It is certified that error appears in the above-identified patent and that said Letters Patent is hereby corrected as shown below:

Column 1, line 37, delete "cheked" and insert therefor --checked--.

Column 2, lines 20 and 23, delete "comprised of", both occurrences, and insert therefor --comprises--.

Column 3, line 2, delete "was" and insert therefor --is--;
Line 37, delete "were" and insert therefor --are--.

Column 4, line 54, after "In", insert --the--.

Column 6, line 24, delete "was" and insert therefor --is--.

Column 7, line 40, delete "was" and insert therefor --is--.

Column 11, line 35, after "onto", insert --which--.

Column 12, line 41, after "onto", insert --which--.

Signed and Sealed this

Twenty-fifth Day of August, 1998

Bruce Lehman

*Attest:*

BRUCE LEHMAN

*Attesting Officer*

*Commissioner of Patents and Trademarks*